United States Patent [19]

Batchelor

[11] Patent Number: 4,880,332

[45] Date of Patent: Nov. 14, 1989

[54] COLLAPSIBLE BARRIER FOR VEHICULAR TRAFFIC

[76] Inventor: Paul S. Batchelor, 42 Ashmore Street, Erskinville, New South Wales, 2043, Australia

[21] Appl. No.: 235,682

[22] PCT Filed: Aug. 18, 1987

[86] PCT No.: PCT/AU87/00272

§ 371 Date: Apr. 14, 1988

§ 102(e) Date: Apr. 14, 1988

[87] PCT Pub. No.: WO88/01320

PCT Pub. Date: Feb. 25, 1988

[30] Foreign Application Priority Data

Aug. 18, 1986 [AU] Australia ..... PH7474

[51] Int. Cl.[4] ..... E01F 13/00

[52] U.S. Cl. ..... 404/6; 188/32

[58] Field of Search ..... 404/6, 9, 10; 49/49, 49/131; 40/610, 903; 188/32; 116/63 P, 63 R; 256/64; 248/165, 166

[56] References Cited

U.S. PATENT DOCUMENTS

| | | | |
|---|---|---|---|
| 2,316,178 | 4/1943 | Morgensen, Jr. | 188/32 |
| 3,630,491 | 12/1971 | Puccio | 256/64 |
| 3,750,331 | 8/1973 | Renaux | 49/131 X |
| 4,134,643 | 1/1979 | Lee | 116/63 P X |
| 4,279,105 | 7/1981 | Cameron | 404/10 X |

*Primary Examiner*—Jerome W. Massie, IV
*Assistant Examiner*—Matthew Smith
*Attorney, Agent, or Firm*—Louis Weinstein

[57] ABSTRACT

A collapsible barrier for vehicular traffic comprising two members (3, 4) pivotally connected to base means (1, 2) thereby enabling the members to be raised into an operative vehicle obstructing condition and to be lowered to an inoperative position to allow vehicles to pass over the members, and releasable lock means (17) to secure the members together in the raised operative condition.

3 Claims, 1 Drawing Sheet

COLLAPSIBLE BARRIER FOR VEHICULAR TRAFFIC

This invention relates to a collapsible barrier for vehicular traffic and has particular use as a means to isolate a vehicle in a defined area, to deter theft of the vehicle, or to isolate a vacant parking area so as to prevent use of the parking area by an unathorised vehicle.

Broadly the invention can be said to comprise two inverted generally Vee shaped members with the free ends of the legs of the members pivotally connected to base means with the axes of pivoting of the respective members parallel thereby enabling the members to be raised into an operative vehicle obstructing condition with the apexes of the Vee members in close physical relationship and elevated above the base means and to be lowered to an inoperative position to allow vehicles to pass over the members, and releasable lock means to secure the members together in the operative condition.

Figure 1:
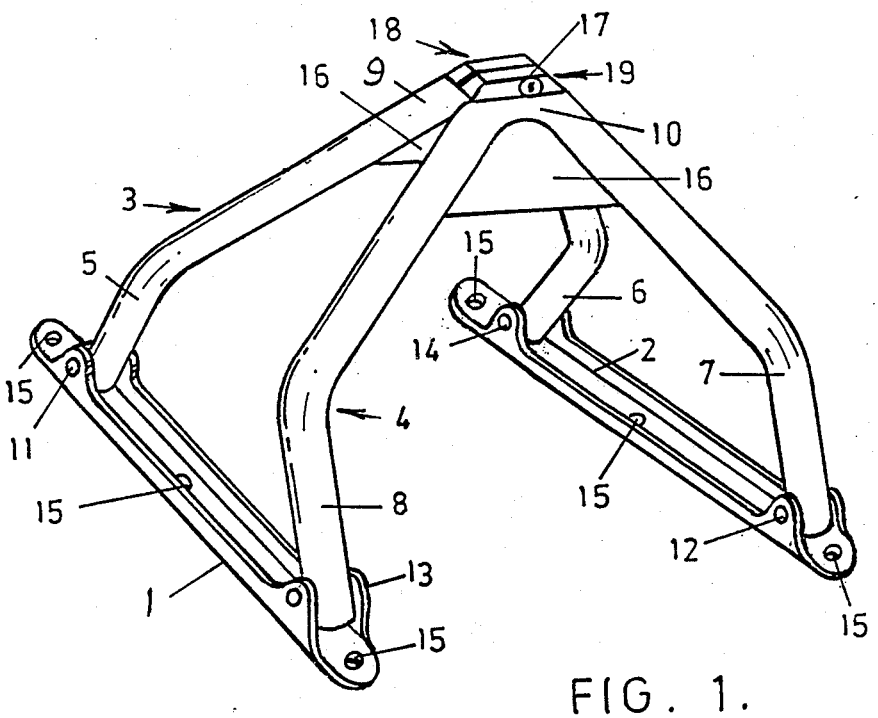
Figure 2:
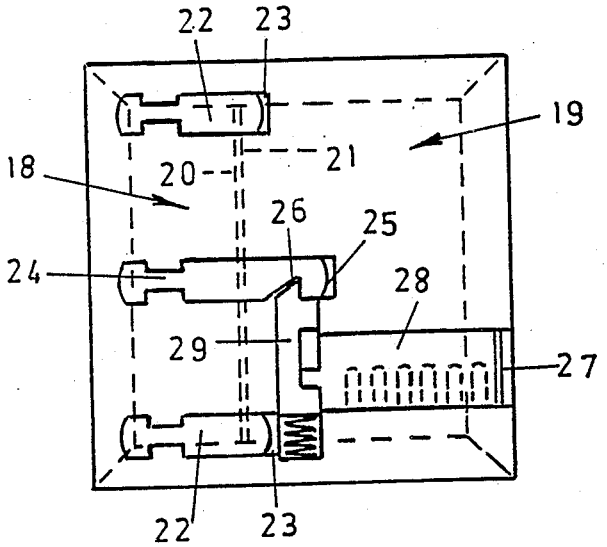

A presently preferred embodiment of the invention will now be described with reference to the accompanying drawings in which:

FIG. 1 is a perspective view of the collapsible barrier in the raised operative condition and FIG. 2 is a fragmentary view showing one form of lock means for the barrier.

In FIG. 1 there is provided a base means which is in the form of two channels 1 and 2 with two generally Vee shaped members 3 and 4 with legs 5, 6 and 7, 8 respectively. The legs 5, 6, meet to form an apex 9 and the legs 7, 8 meet to form an apex 10. The ends of the legs 5 to 8 are pivotally connected to the channels 1 and 2 at the positions indicated 11 to 14. The channels 1 and 2 are provided with holes 15 whereby the channels 1 and 2 can be fixed to the ground.

The form of the base means illustrated is the preferred form but it is to be understood that the four connections 11 to 14 could be to a common plate type base or the channels 1 and 2 could be connected respectively between the legs 5, 6 and 7, 8 rather than as shown where they are connected between the legs 5, 7 and 6, 8.

A reinforcing web 16 is provided at the apex of each member 3 and 4. A releasable locking means is provided whereby the apexes 9, 10 of the members 3, 4 can be releasable connected together when in the raised and operative vehicle obstructing condition.

The preferred form of locking means is shown in FIG. 2 and comprises a lug 18 on the apex 9 and a lug 19 on the apex 10. There are faces 20 and 21 on the lugs 18 and 19 respectively and locating pins 22 project from the face 20 and these can be accomodated in suitable holes 23 in the lug 19. There is a locking pin 24 fixed in the lug 18 and it projects from the face 20 and is received in a hole 25 in the lug 19. There is a notch 26 in the pin 24.

Located within the lug 19 there is a housing 27 for a key operated locking cylinder 28 of known type. On the end of the cylinder 28 adjacent the face 21 and housed in a recess therein there is an arm 29 that is fixed to and rotates with the cylinder 28. The dimensioning of the members is such that when the faces 20, 21 are in operative relationship the notch 26 will be aligned with the arm 29 so that by rotation of the cylinder 28 by a key the arm 29 will engage in the notch 26 thereby preventing the separation of the lugs 18 and 19.

By disengagement of the arm 29 from the notch 26 the members 3 and 4 can be separated in the direction of the arrows in FIG. 1 so the members 3 and 4 can adopt lowered inoperative positions allowing vehicles to pass over the barrier means.

The locking means just described is a preferred arrangement but other forms of releasable locking means could be used.

It is to be understood that the notch 26 can be located on the pin 24 in a position such that the faces 20 and 21 are separated when the barrier is in the raised locked condition. This would allow anchor means, such as a link of a chain or the like to be hooked onto the pin 24 to secure a trailer or caravan or the like to the barrier when it is locked. In this way the barrier serves as a anchorage for the trailer or caravan whilst at the same time preventing the movement of the chained trailer or caravan from the area obstructed by the barrier.

I claim:

1. A collapsible barrier comprising two inverted generally Vee shaped members with the free ends of the legs of the members pivotally connected to base means with the axes of pivoting of the respective members parallel thereby enabling the members to be raised into an operative vehicle obstructing condition with the apexes of the Vee members in close physical relationship and elevated above the base means and to be lowered to an inoperative position to allow vehicles to pass over the members, and releasable lock means to secure the members together in the operative condition.

2. A barrier as claimed in claim 1 wherein the base means comprised two channels in parallel spaced relationship with the ends of corresponding first legs of the members pivotally connected to one channel and the ends of the other legs of the members pivotally connected to the other channel.

3. A barrier as claimed in claim 1 wherein the releasable lock means comprises a lug projecting from the apex of one member and a hole in the apex of the other member to receive the lug and latch means on the lug engagable by movable catch means mounted on the other of said members.

* * * * *